United States Patent [19]

Campbell

[11] 4,295,312

[45] Oct. 20, 1981

[54] BUILDING CONSTRUCTION

[75] Inventor: Henry F. Campbell, Belleville, Mich.

[73] Assignee: Campbell Research Corporation, Detroit, Mich.

[21] Appl. No.: 5,473

[22] Filed: Jan. 22, 1979

[51] Int. Cl.[3] ..... E04B 1/40; E04B 7/00

[52] U.S. Cl. ..... 52/408; 52/465; 52/468; 52/694; 52/795; 52/809

[58] Field of Search ..... 52/694, 468, 795, 465, 52/796, 84, 275, 481, 630, 490, 86, 693, 90, 690, 691, 692, 639, 640, 417, 408, 809

[56] References Cited

U.S. PATENT DOCUMENTS

| | | | |
|---|---|---|---|
| 1,880,480 | 10/1932 | Ragsdale | 52/692 |
| 3,500,596 | 3/1970 | Andersson | 52/795 |
| 3,842,560 | 10/1974 | Campbell | 52/694 |
| 3,882,653 | 5/1975 | Ollman | 52/694 |
| 4,078,351 | 3/1978 | Simpson | 52/592 |

*Primary Examiner*—John E. Murtagh

*Attorney, Agent, or Firm*—Barnes, Kisselle, Raisch & Choate

[57] ABSTRACT

A building construction comprising a plurality of panels. Each panel comprises spaced sheets and a plurality of spaced longitudinally extending truss members. Each truss member comprises a pair of channels and an undulating member comprising alternating first and second apices connected by legs, the apices being bonded to the channels. At least one of the sheets has longitudinally extending grooves receiving the truss members. The grooves have a cross sectional configuration conforming to the cross sectional configuration of the channel of the truss member. The channels are fastened to the sheet. The panels may be used in the side wall or roof of a building.

7 Claims, 17 Drawing Figures

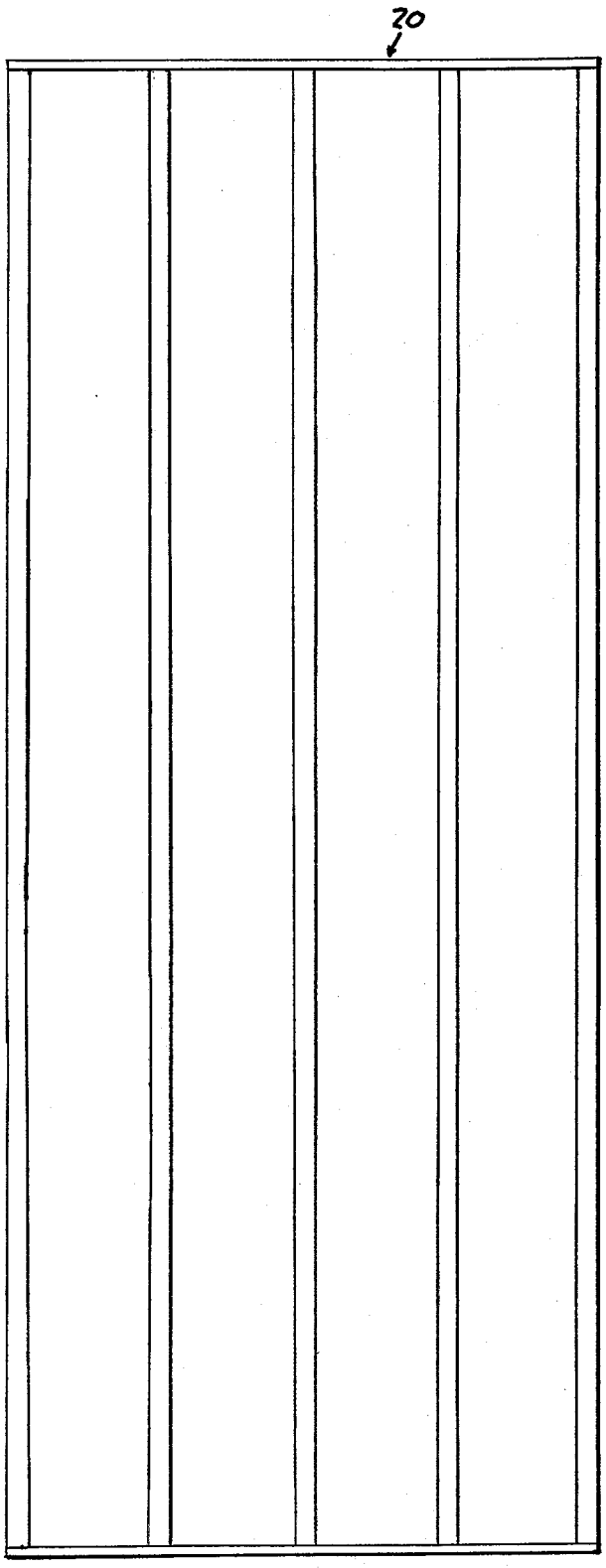
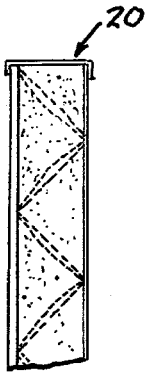
FIG. 5
FIG. 4

BUILDING CONSTRUCTION

This invention relates to building construction and particularly to buildings utilizing pre-fabricated panels.

BACKGROUND AND SUMMARY OF THE INVENTION

It is common to provide and utilize pre-fabricated panels in the side wall and roof structures of buildings. In such use, it is important to provide a low-cost strong structure which at the same time can be easily and economically manufactured.

In U.S. Pat. No. 3,882,653 there is disclosed and claimed a panel comprising spaced sheets and a plurality of truss members interposed between the sheets, each truss member comprising a pair of channels and an undulating member comprising alternating apices bonded to the channels.

Accordingly, among the objectives of the present invention are to provide a building construction and method of manufacturing panels which is an improvement over the panels shown in the aforementioned U.S. Pat. No. 3,882,653; utilizes prefabricated panels that can be readily assembled, either at a factory or on the job, utilizing relatively unskilled labor; which will provide a strong economical structure; and which can be readily adapted to various types of buildings.

DESCRIPTION OF THE DRAWINGS

FIG. 4 is a view on an enlarged scale of a panel utilized in FIG. 1.

FIG. 5 is a fragmentary side view of the panel.

DESCRIPTION

Figure 1:
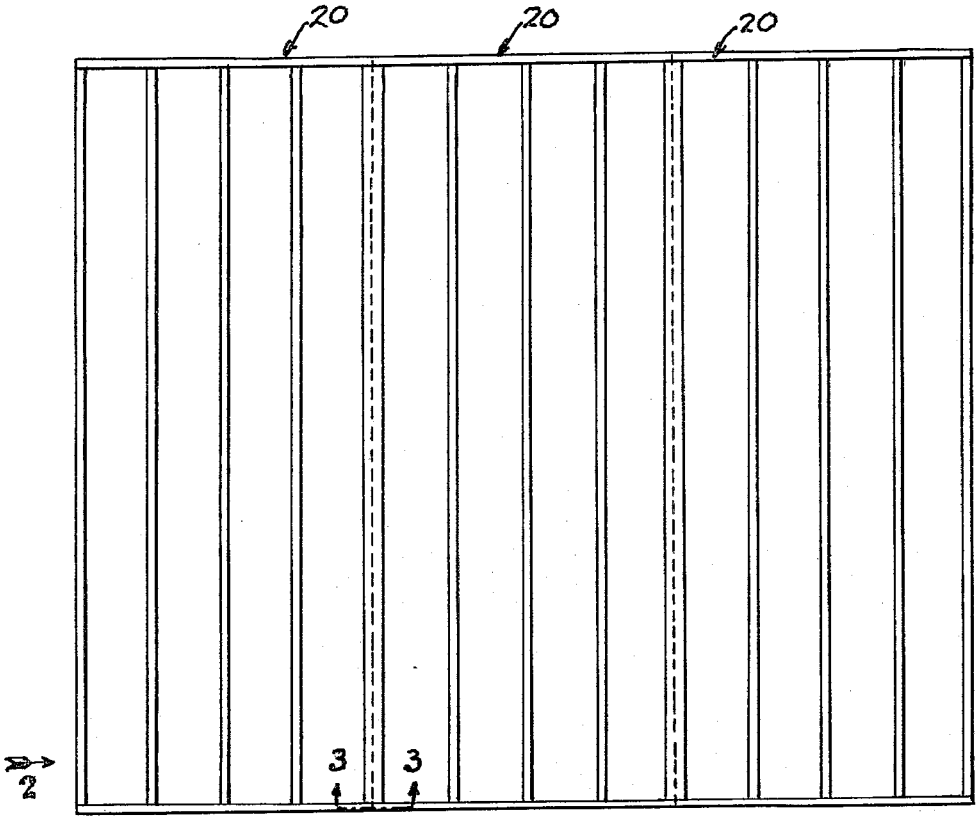
FIG. 1 is an elevational view of a plurality of building panels forming a side wall of a building.
Figure 6:
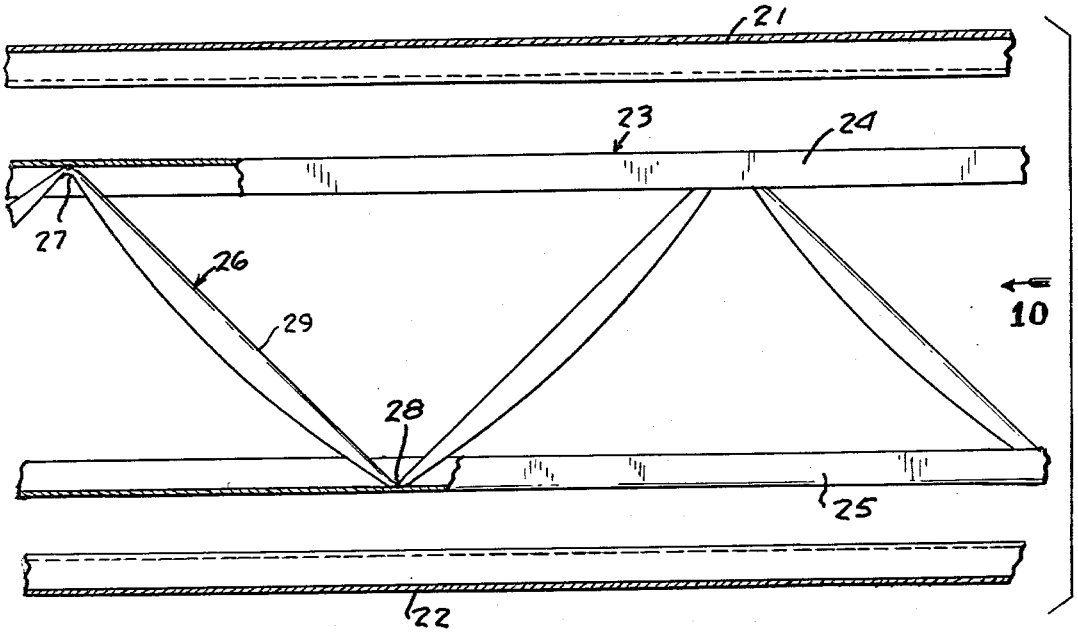
FIG. 6 is an exploded fragmentary part sectional view with a portion of the panel during assembly.

Referring to FIG. 1, the building construction embodying the invention comprises a plurality of panels 20 in side-by-side relation, herein shown as the wall of the building. Each panel includes spaced sheets 21, 22 made of metal or other material and a plurality of longitudinally spaced prefabricated truss members 23 (FIG. 6). Each truss member 23 included channels 24, 25 and an undulating member 26 comprising apices 27, 28 and legs 29, the apices 27 being bonded to the channel 24 and the apices 28 being bonded to the channel 25. A preferred form of truss member is such as shown in the U.S. Pat. No. 3,882,653 to Ollman issued May 13, 1975.

Figure 9:
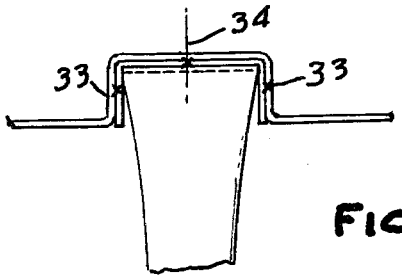
FIG. 9 is a fragmentary view of a modified form.
Figure 8:
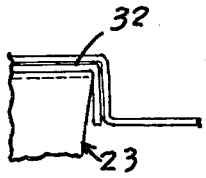
FIG. 8 is a fragmentary view of a portion of the panel shown in FIG. 7.

Each of the sheets 21, 22 is formed with longitudinally extending grooves 30, 31 into which the prefabricated truss members 23 extend, the depth of each groove 30, 31 being substantially equal to the height of the side walls of the channel 24, 25. The truss members are joined to the sheet members in the area of the grooves. In a preferred form, such as shown in FIG. 8, a layer of adhesive is provided between the base portion and the side wall portions of the grooves. Alternatively, as shown in FIG. 9, the joining may be provided by spot welds 33 at the side wall of the groove or welds 34 at the base of the grooves. Where the panels are exposed, it is preferred that the welds 33 along the side walls be used rather than the welds 34 along the base of the grooves.

Figure 10:
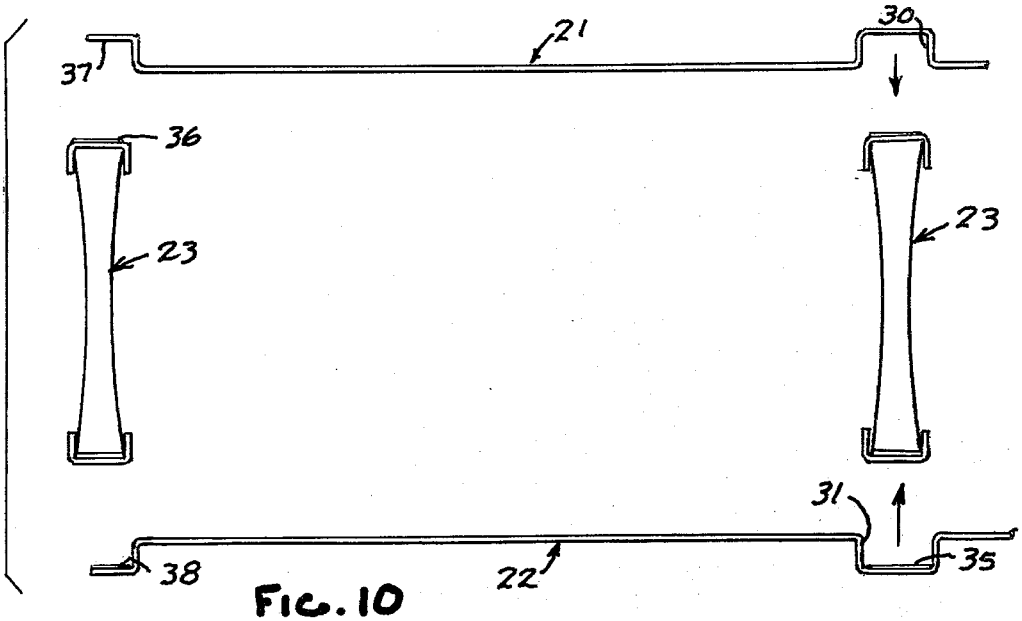
FIG. 10 is an exploded fragmentary view taken in the direction of the arrow 10 in FIG. 6.

Referring to FIG. 6 and 10, the panels are preferably formed by placing the sheet 22 having the grooves 31 therein horizontally, applying a layer of adhesive 35 to the base of the grooves and positioning each truss member 23 in the grooves. A layer of adhesive 36 is then applied to the base of the grooves of the second sheet 21 and the sheet 21 is brought downwardly onto the upper channel. Alternatively, instead of utilizing adhesive, welds or screws may be applied after the truss members and sheets have been assembled.

Sheets 21, 22 can have different thicknesses. Thus, sheet 22 can be made heavier where it is to form the outer wall of a building. Furthermore, the sheets 21, 22 may be painted before assembly in which case adhesive is preferred as a means of fastening the truss members to avoid the damage to the paint or coating that might be caused by welds.

Figure 2:
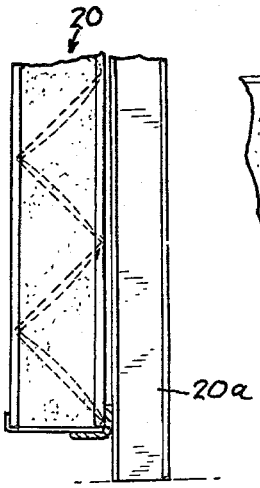
FIG. 2 is a fragmentary sectional view taken in the direction of the arrow 2 in FIG. 1.
Figure 7:
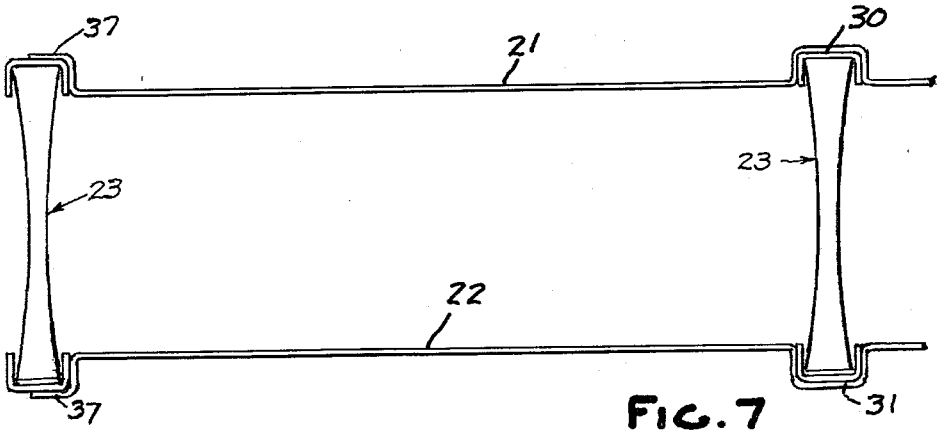
FIG. 7 is a fragmentary end view of a panel.

In the form of the invention shown in FIGS. 1 and 2, the panels 20 are utilized adjacent a wall or column 20*a*. In the form of the invention shown in FIGS. 7 and 10, each sheet 21, 22 includes a partial groove 37, 38 along each longitudinal edge thereof into which the endmost truss is positioned. The partial groove 37 has a base which has a width less than the base of the channel so that the free edge of each sheet 21, 22 lies intermediate the side edges of the base of the corresponding channel. When the sheets 21, 22 are made of metal, the edges of the sheets can be welded to the bases of the corresponding channels.

Figure 11:
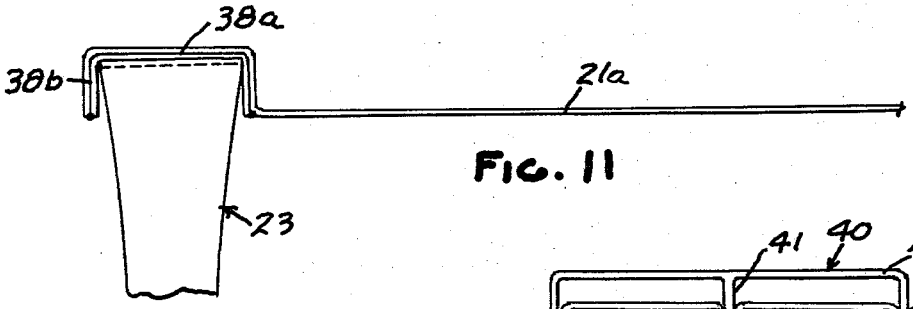
FIG. 11 is a fragmentary view of a modified form of panel.

In the modified form of panel shown in FIG. 11, the sheet 21*a* includes a complete groove 38*a* along each edge so that the groove 38*a* has a co-extensive flange 38*b* with the flange of the adjacent truss member.

Figure 3:
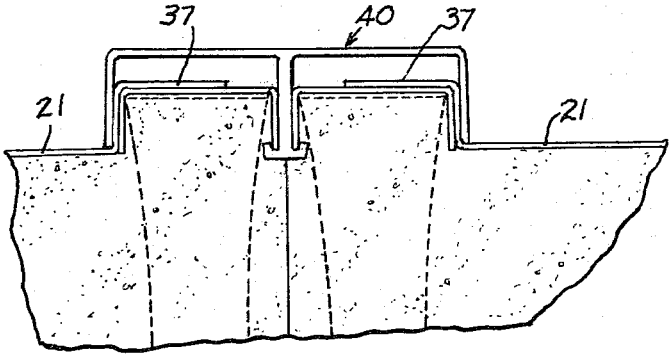
FIG. 3 is a fragmentary sectional view taken along the line 3—3 in FIG. 1.
Figure 12:
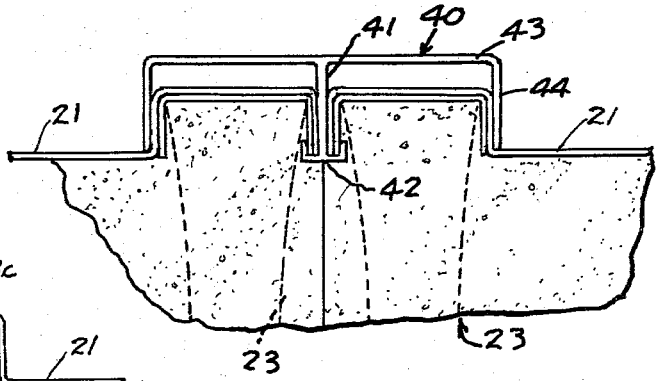
FIG. 12 is a fragmentary sectional view through a joint between adjacent panels.

A joint can be provided by utilizing a joint member 40 that is generally T-shaped and has a web 41 extending between the panels and an end portion 42 then engages the free edges of the flanges of the adjacent truss members 23. The T-shaped member 40 includes a horizontal portion 43 and inwardly extending legs 44 engaging the outer surfaces of the sheets 21, 22 along the side walls of the grooves (FIG. 12) as the case may be. Where a partial groove 37 is provided along each edge of sheets 21, 22, the joint member 40 has its web 41 adjacent the channels as shown in FIG. 3.

Figure 13:
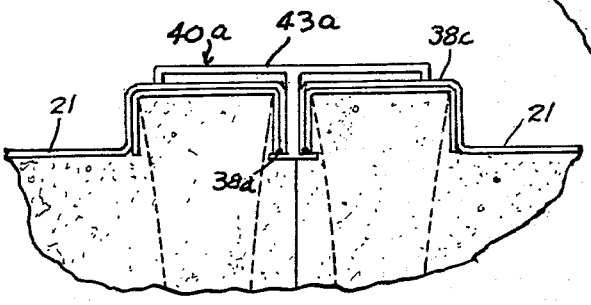
FIG. 13 is a fragmentary sectional view of a modified form of joint construction between adjacent panels.

In the modified form of joint member shown in FIG. 13, the T-shaped member 40*a* has the portion 43*a* engaging the base 38c rather than the sides 38b of the grooves 38a of the sheet. A weld 38d is at the junction of flanges 38b and the channel.

Figure 14:
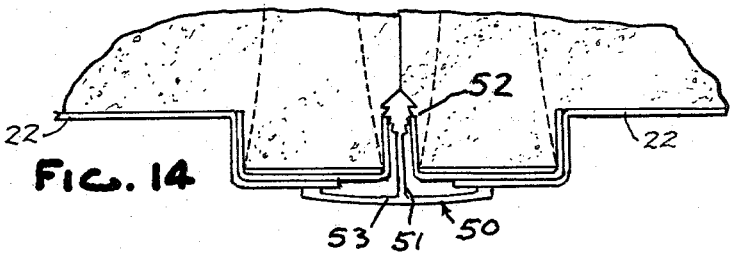
FIG. 14 is a fragmentary sectional view of a further modified form of joint between adjacent panels.

In the form of the invention shown in FIG. 14, a seal is provided, for example, on the interior or the exterior of the building, by a plastic T-shaped strip 50 that has a web 51 and serrated edges 52 that extend between the flanges of adjacent truss members. The member 50 further includes a cross member 53 that engages the outer surfaces of the sheet members.

Figure 15:
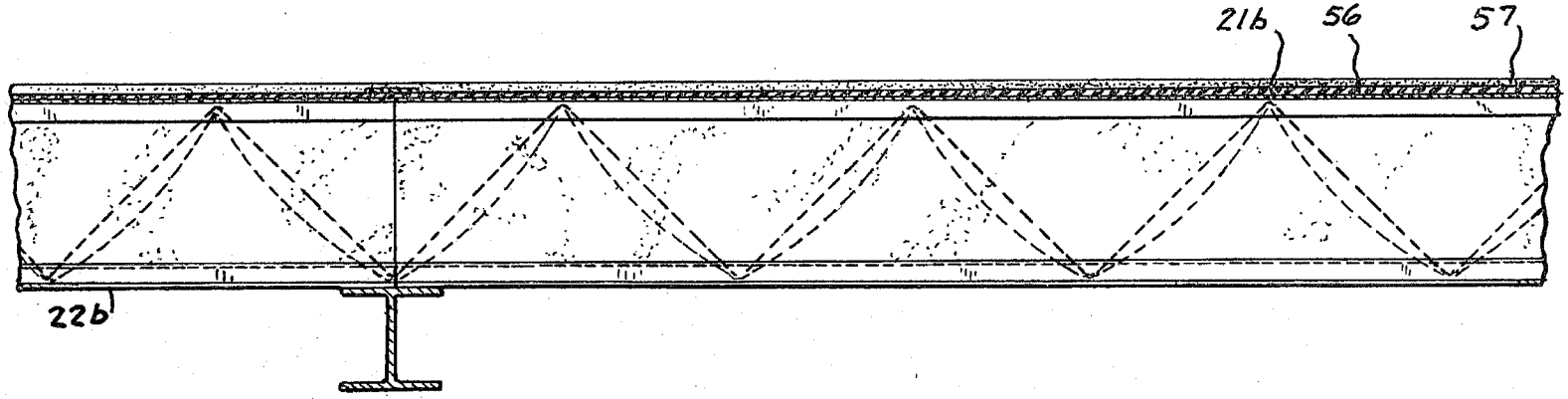
FIG. 15 is a fragmentary vertical sectional view of a roof embodying the invention.
Figure 16:
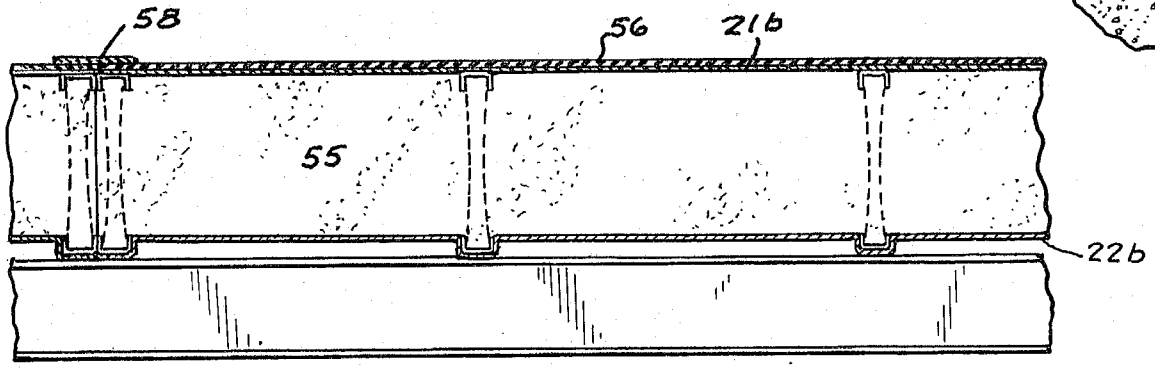
FIG. 16 is a fragmentary sectional view taken along line 16—16 in FIG. 15.

As shown in FIGS. 15 and 16, the panels embodying the invention may also by utilized in roof construction. In this form, the one sheet 21b need not have the grooves therein and only the sheet 22b facing the interior of the building is provided with the grooves in which the truss members are positioned. Insulation 55 can be provided between the sheet member 21b, 22b so that no insulation is needed on the roof. The roof over the panels can be formed by a flexible membrane 56 of vinyl or similar membrane material which completely overlies all of the panels but is not adhered thereto and an aggregate 57 applied loosely over the membrane to hold the membrane in position. The insulation can be placed during assembly or, if flowable such as foam, can be poured into the panel after it is assembled by positioning the panel on edge and pouring flowable insulation between the sheets. Where it can set.

Figure 17:
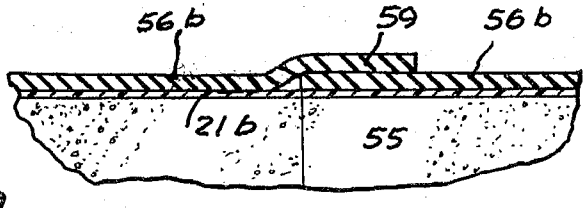
FIG. 17 is a fragmentary sectional view of a further modified form of the invention.

Alternatively, sections 56a of the membrane can be adhered to the upper sheets and when the panels are assembled in side-by-side relationship, a sealing strip 58 may be adhered to adjacent panels and no aggregate is required (FIG. 16). In a modified form, the prefabricated panels with the membrane 56b attached thereto are such that there is a free lip 59 on each membrane along the edge of the panel so that when the panels are brought into adjacent relationship, lip 59 overlies the membrane 56b of the adjacent panel and can be adhered thereto by adhesive to provide the seal (FIG. 17).

It can thus be seen that the panels embodying the invention can be readily assembled utilizing relatively unskilled labor, are strong and economical and are readily adapted for use as wall or roof structures with or without insulation, are energy conserving and designed to be readily removed and reused.

Where the panels need less strength, either sheet facing the interior of the building could be made flat without grooves 30.

I claim:

1. A building construction comprising a panel comprising spaced sheets and a plurality of spaced longitudinally extending prefabricated truss members, each said truss member comprising a pair of channels and an undulating member comprising alternating first and second apices connected by legs, the apices being bonded to said channels, at least one of said sheets having a plurality of transversely spaced longitudinally extending grooves receiving the truss members, said grooves having a cross sectional configuration conforming to the cross sectional configuration of the channel of said truss member, and means for fastening said last-mentioned channel to said sheet, said sheet having said grooves therein including a partially extending groove along each longitudinal edge in which a truss member is positioned, the corresponding channel of the truss member including a base wall and side walls, the free edge of the sheet terminating along the base wall of the channel, adjacent panels being positioned such that they extend parallel with one another in side-by-side relation, a plurality of said panels, means defining a joint between adjacent panels comprising a member which has a generally T-shaped section including a web extending between the flanges of adjacent truss members of panels and engaging the free edges of said flanges of the adjacent channels of said truss members and arms extending laterally outwardly and including portions extending inwardly against the sides of the partial groove in the sheet member.

2. A building construction comprising a panel comprising spaced sheets and a plurality of spaced longitudinally extending prefabricated truss members, each said truss member comprising a pair of channels and an undulating member comprising alternating first and second apices connected by legs, the apices being bonded to said channels, at least one of said sheets having a plurality of transversely spaced longitudinally extending grooves receiving the truss members, said grooves having a cross sectional configuration comforming to the cross sectional configuration of the channel of said truss member, and means for fastening said last-mentioned channel to said sheet, a plurality of said panels, each said sheet having the groove therein includes a groove adjacent the longitudinal edge thereof having side walls, a truss member in each said groove, adjacent panels extending parallel to one another in side-by-side relation, and means defining a joint between adjacent panels comprising a member which has a generally T-shaped section including a web extending between the side walls of said adjacent grooves of adjacent panels and engaging the free edges of the sheets of adjacent panels and arms extending laterally outwardly and including portions extending inwardly against the side walls of the grooves adjacent the longitudinal edges.

3. A building construction comprising a panel comprising spaced sheets and a plurality of spaced longitudinally extending prefabricated truss members, each said truss member comprising a pair of channels and an undulating member comprising alternating first and second apices connected by legs, the apices being bonded to said channels, at least one of said sheets having a plurality of transversely spaced longitudinally extending grooves receiving the truss members, said grooves having a cross sectional configuration conforming to the cross sectional configuration of the channel of said truss member, and means for fastening said last-mentioned channel to said sheet, a weld extending along the free edges of the sheet and the flange of the channel of the truss member which extends along the free edge of the panel.

4. A building construction comprising a panel comprising spaced sheets and a plurality of spaced longitudinally extending prefabricated truss members, each said truss member comprising a pair of channels and an undulating member comprising alternating first and second apices connected by legs, the apices being bonded to said channels, at least one of said sheets having a plurality of transversely spaced longitudinally extending grooves receiving the truss members, said grooves having a cross sectional configuration conforming to the cross sectional configuration of the channel of said truss member, and means for fastening said last-mentioned channel to said sheet, a plurality of said panels positioned in side-by-side relationship to define a roof deck, said sheets with said grooves therein facing inwardly of the building, and a membrane overlying said opposite sheets.

5. The building construction set forth in claim 4 including insulating material beneath said membrane.

6. The building construction set forth in claim 4 wherein said membrane comprises a membrane section on each said panel, and a resilient sealing strip is provided at the juncture of adjacent panels and adhered to the adjacent membrane sections to provide a joint.

7. The building construction set forth in claim 4 wherein said membrane comprises a section adhered to each said panel, each said membrane section having a peripheral lip along one edge of said panel overlying the membrane section of the adjacent panel and adhered thereto.

* * * * *